US009856052B2

(12) United States Patent
O'Leary et al.

(10) Patent No.: US 9,856,052 B2
(45) Date of Patent: Jan. 2, 2018

(54) MOLDED CONTAINER HAVING AN INTEGRALLY FORMED LOWER HANDLE

(71) Applicants: Brian O'Leary, Dayton, OH (US); David S Quinn, Ringwood, IL (US); Casey Holder, Mt Dora, FL (US); Ron German, Liberty Township, OH (US)

(72) Inventors: Brian O'Leary, Dayton, OH (US); David S Quinn, Ringwood, IL (US); Casey Holder, Mt Dora, FL (US); Ron German, Liberty Township, OH (US)

(73) Assignee: Bucket Innovations, UC, Mount Dora, FL (US)

( * ) Notice: Subject to any disclaimer, the term of this patent is extended or adjusted under 35 U.S.C. 154(b) by 0 days.

(21) Appl. No.: 14/271,315

(22) Filed: May 6, 2014

(65) Prior Publication Data

US 2015/0321796 A1 Nov. 12, 2015

(51) Int. Cl.

| | |
|---|---|
| ***B65D 25/28*** | (2006.01) |
| ***B65D 25/22*** | (2006.01) |
| ***B65D 21/02*** | (2006.01) |
| ***B65D 1/42*** | (2006.01) |
| ***B65D 3/06*** | (2006.01) |
| *B65D 25/30* | (2006.01) |

(52) U.S. Cl.

CPC ..... *B65D 21/0233* (2013.01); *B65D 1/42* (2013.01); *B65D 3/06* (2013.01); *B65D 25/2808* (2013.01); *B65D 25/2882* (2013.01)

(58) Field of Classification Search

CPC ..... B65D 25/30; B65D 25/2808; B65D 25/2805; B65D 25/2897; B65D 25/2885; B65D 21/0233; B65D 1/42; B65D 3/06; B65D 25/2882

USPC ..... 220/770, 771, 755, 761, 908

See application file for complete search history.

(56) References Cited

U.S. PATENT DOCUMENTS

| | | | | |
|---|---|---|---|---|
| 4,351,539 | A * | 9/1982 | Rodolakis | B65F 1/1468 206/519 |
| 4,440,321 | A * | 4/1984 | Campbell | B65F 1/12 100/218 |
| 4,841,596 | A | 6/1989 | Fink | |
| 5,235,795 | A | 8/1993 | Debusk | |
| 5,390,818 | A | 2/1995 | Labuda | |
| 5,535,910 | A | 7/1996 | Cassel | |
| 5,547,104 | A * | 8/1996 | Parker | 220/772 |
| 6,182,856 | B1 * | 2/2001 | Berrenberg et al. | 220/771 |
| 6,471,221 | B1 * | 10/2002 | McGarry | 280/47.26 |

(Continued)

OTHER PUBLICATIONS

International Search Report, dated Jul. 29, 2015.

*Primary Examiner* — J. Gregory Pickett
*Assistant Examiner* — Niki M Eloshway
(74) *Attorney, Agent, or Firm* — Stephen C. Thomas

(57) ABSTRACT

An injection-molded plastic bucket with a base, a substantially circumferential wall expanding conically upward to an upper edge, and a pouring handle, where a lower edge of the wall is provided with a recess for the pouring handle, and a process for manufacturing an injection-molded plastic bucket. The bucket design is such the mold costs and curing time can be reduced and of which the universal utility of the molds can be improved, this task being solved in that the plastic bucket is molded in one piece, where the pouring handle is of substantially the same thickness as the bucket wall, and is integrally formed with the bucket body.

11 Claims, 9 Drawing Sheets

(56) References Cited

U.S. PATENT DOCUMENTS

| | | | | |
|---|---|---|---|---|
| 6,581,796 | B1 * | 6/2003 | Pilkinton | 220/495.04 |
| 6,808,081 | B1 * | 10/2004 | Citro | 220/772 |
| 7,686,168 | B1 | 3/2010 | Smiley | |
| 8,757,428 | B2 * | 6/2014 | Daudelin | 220/761 |
| 2006/0175340 | A1 * | 8/2006 | Garone | 220/772 |
| 2012/0012595 | A1 | 1/2012 | Yourist | |
| 2014/0361026 | A1 | 12/2014 | Carnesecca | |

* cited by examiner

MOLDED CONTAINER HAVING AN INTEGRALLY FORMED LOWER HANDLE

BACKGROUND OF THE INVENTION

Plastic buckets are generally manufactured by mass production. If the carrying handles are manufactured separately from the buckets, their attachment necessitates a substantial outlay, as this requires an additional handle-fitting operation which involves additional automatic handle-fitting machines.

For this reason, attempts are being made to manufacture carrying handle and bucket in a single operation. To this end, unexamined German application 35 40 059 describes a bucket with an articulated bow-type handle which is retained in integrally moulded handle-retaining cages on opposite sides of the bucket by means of knobs on the ends of the handle.

A further known solution is disclosed by U.S. Pat. No. 4,125,246, which describes a mould for a plastic bucket which provides for the handle of the plastic bucket to be moulded in the parting surface between female mould and male mould. Outward-projecting pins are integrally moulded on the upper edge at the locations of the receiving elements. The pins are each encircled by a carrying handle eye connected to the carrying handle.

These devices, however, do not provide for a lower (lifting) handle to assist in pouring the container contents. Moreover, they do not provide a process whereby such handle can be formed integrally during the molding process with minimum addition of material cost or curing time.

SUMMARY OF THE INVENTION

Among the several objects of the invention will be noted a one-piece, molded plastic container having a base and a circumferential sidewall, having a predefined thickness, extending upwardly from the base. The container can vary in size to up to five gallons or more. The upper end of the sidewall forms an open top of the container. The sidewall has a recess molded therewith adjacent the base, projecting inwardly from the sidewall. A lower handle for lifting and pouring the contents of the container is also of an integrally molded plastic. Respective ends of the lower handle are integrally formed with the sidewalls of a recess formed in the lower end of one side the container. A bail is optionally used in connection with container adjacent it's upper end. When the container is full and is lifted by the lower handle, either in conjunction with a bail or holding the upper end, the container hangs horizontally or in an inverted position.

The lower handle, as discussed above, is integrally molded with the polymeric body of the container as part of the body mold. This significantly reduces costs for both the manufacture and assembly of the completed container. Further, the handle has a base section of constant thickness throughout its length. The thickness of the base section of the lower handle is substantially equal to the thickness of the sidewall and all other components of the container.

Other objects and features will be in part apparent and in part pointed out hereinafter.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The container of this invention is shown in FIGS. 1-9B and referenced generally therein by the numeral 10. The container 10 is preferably integrally molded as a unitary article from a thermoplastic formable resin.

Figure 1:
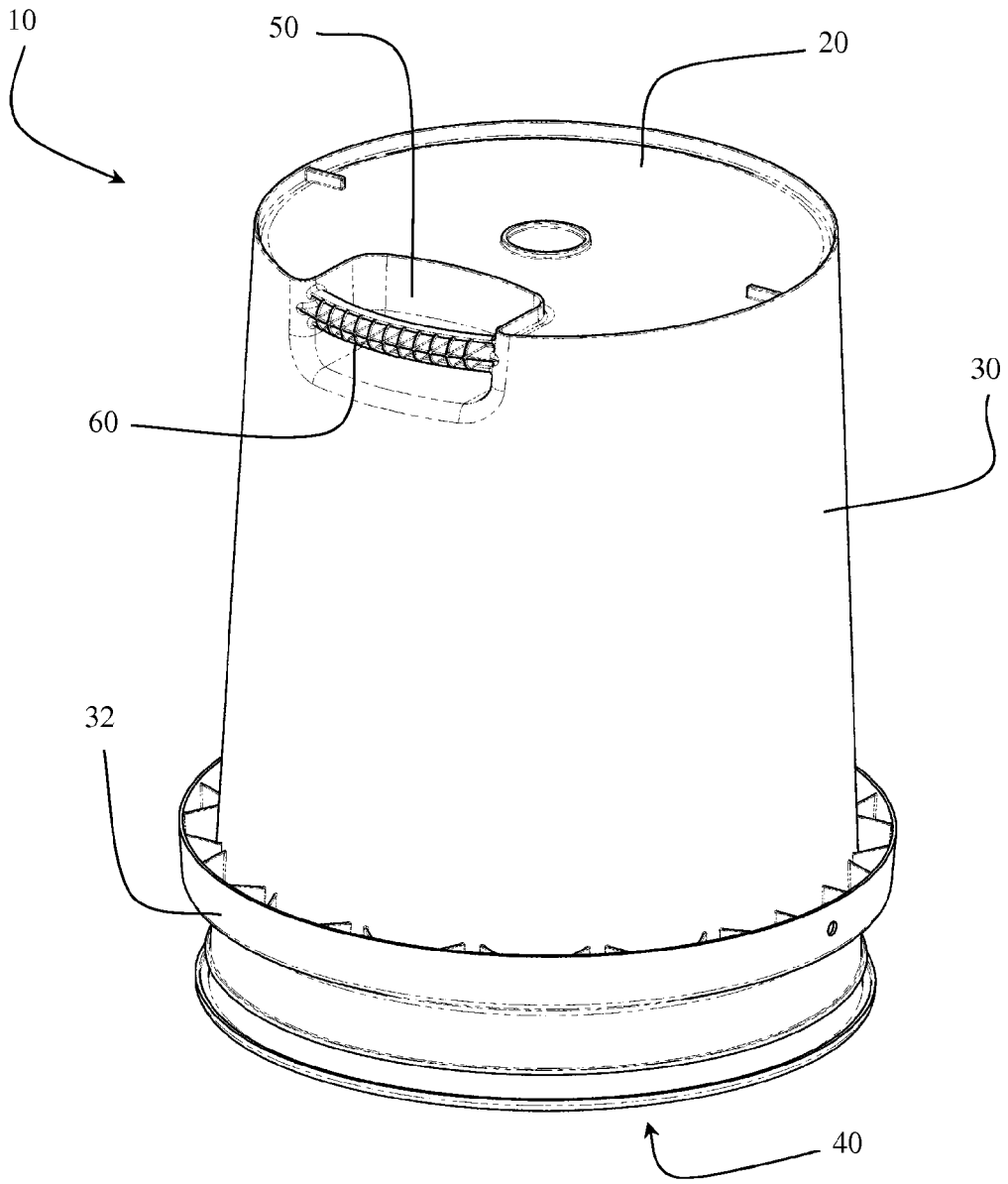
FIG. 1 is an inverted view of the inventive container.
Figure 2:
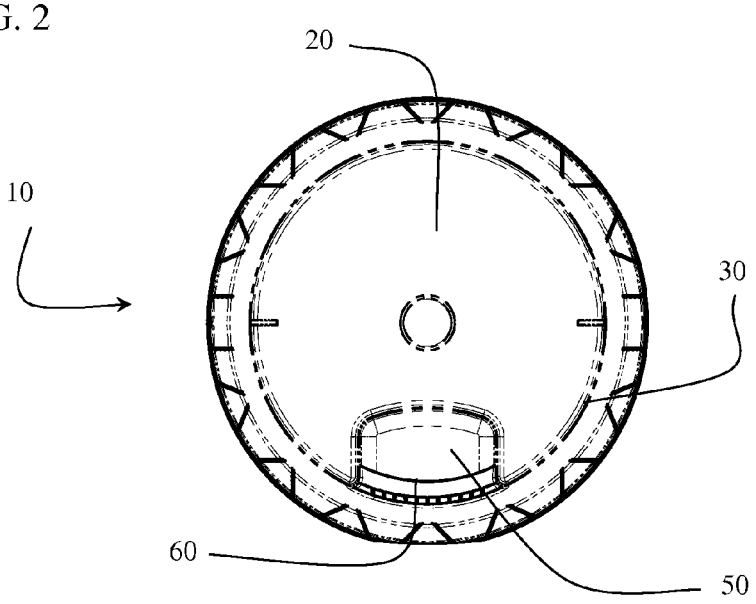
FIG. 2 is a bottom view of the inventive container.
Figure 3:
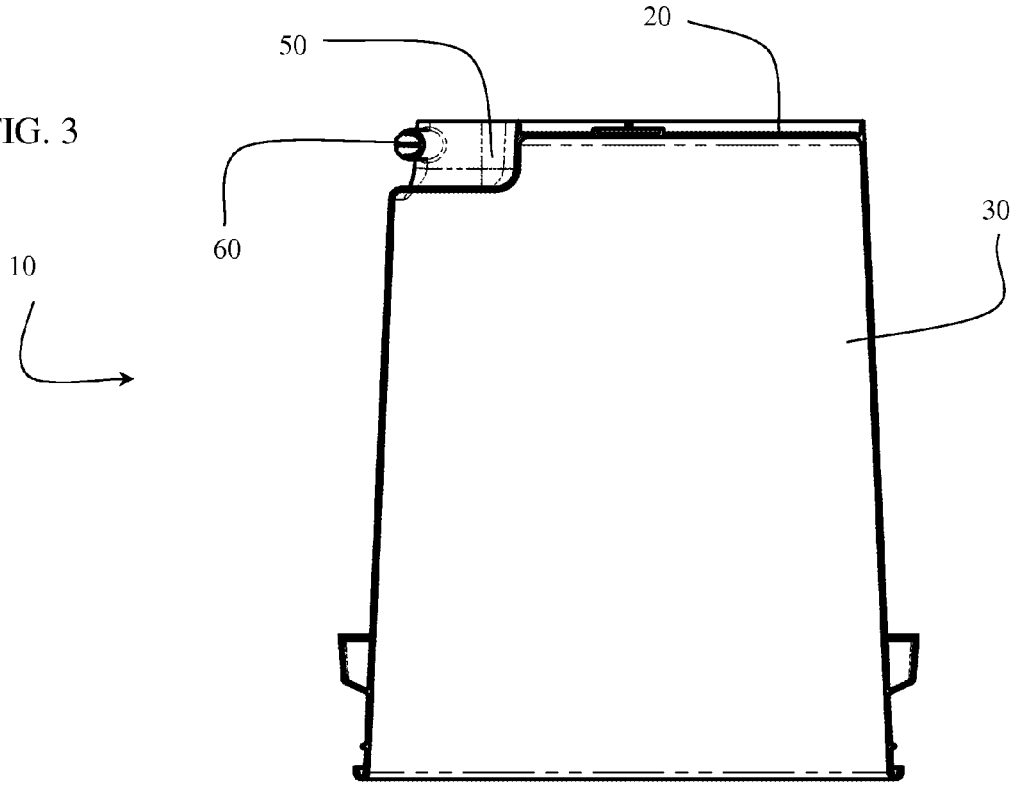
FIG. 3 is a side view of the inventive container.

Referring to FIG. 1, it may be seen that a first embodiment of the container 10 comprises a container body having a generally circular base 20, a generally circumferential upright and cylindrical side wall 30 curving upward uniformly from base 20 and having a slight outward taper such that like containers 10 may be nested in a vertical column within one another, a radially offset portion 32 of the side wall which is disposed radially outside adjacent the top edge 40.

Referring now to FIGS. 3 through 6, a lift handle recess 50 is formed in one side of side wall 30 of the container body. Recess 50 is designed to minimally effect displacement within the interior of container 10 while providing sufficient clearance for a user's hand. Lift handle recess 50 is defined in part by a generally horizontal upper wall 100 and generally vertical terminal wall 120 that extends downwardly from the upper wall 100 and connects to base 20 adjacent its lower end. Lift handle recess 50 is defined laterally by opposing side walls (110*a*/110*b*). By positioning lower handle 60 between side walls 110*a* and 110*b*, the user can easily grasp lower handle 60 without interference from any portion of the container body. Moreover, positioning lower handle 60 inwardly from container side wall 30 allows a first container (10*a*) to nest within the interior of a second container (10*b*) and thereby allow stackability of multiple containers (FIG. 7). Preferably, lift handle recess is disposed adjacent base 20 (thereby being downwardly open), but can be disposed at any suitable location.

Figure 4:
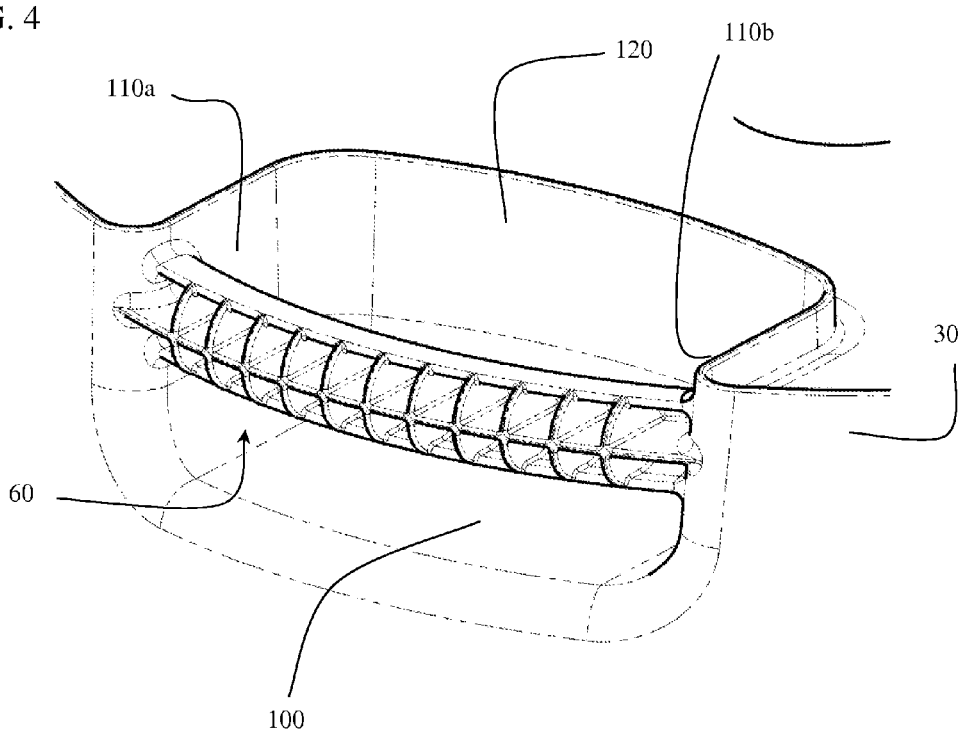
FIG. 4 is a perspective view of the handle recess and integrally formed handle.
Figure 5:
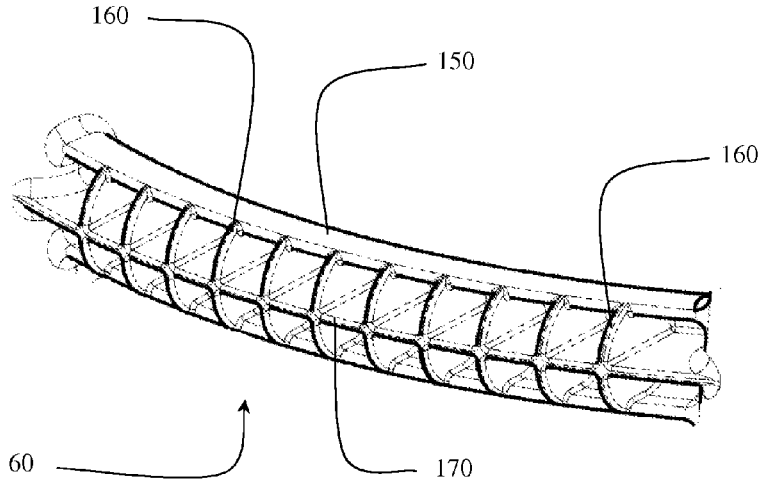
FIG. 5 is a detail view of the substantially U-shaped handle body and supporting structures thereof.
Figure 6:
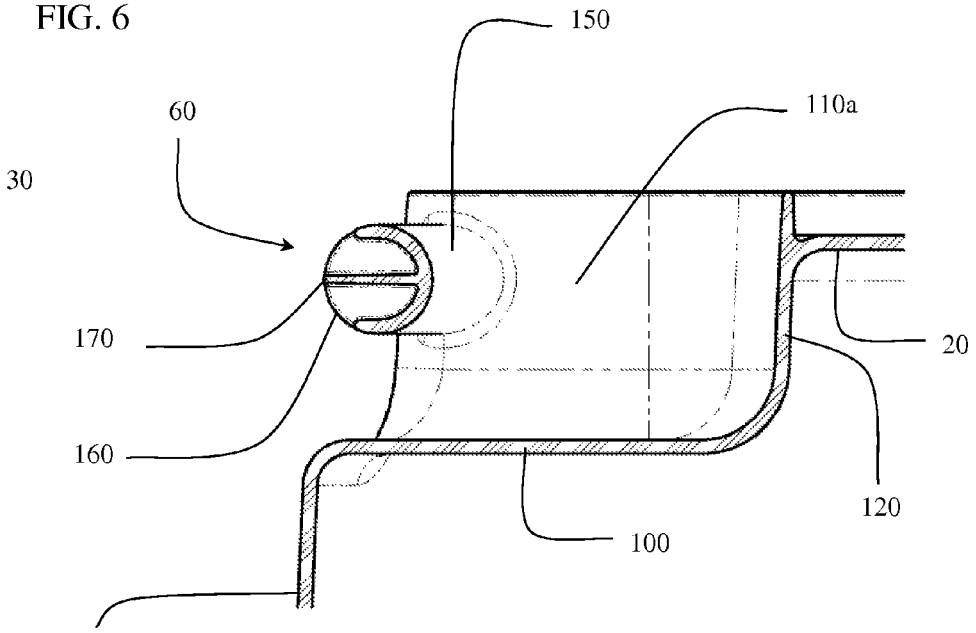
FIG. 6 is a sectional view of the handle recess and integrally formed handle along with the substantially U-shaped handle body and supporting structures thereof.
Figure 7:
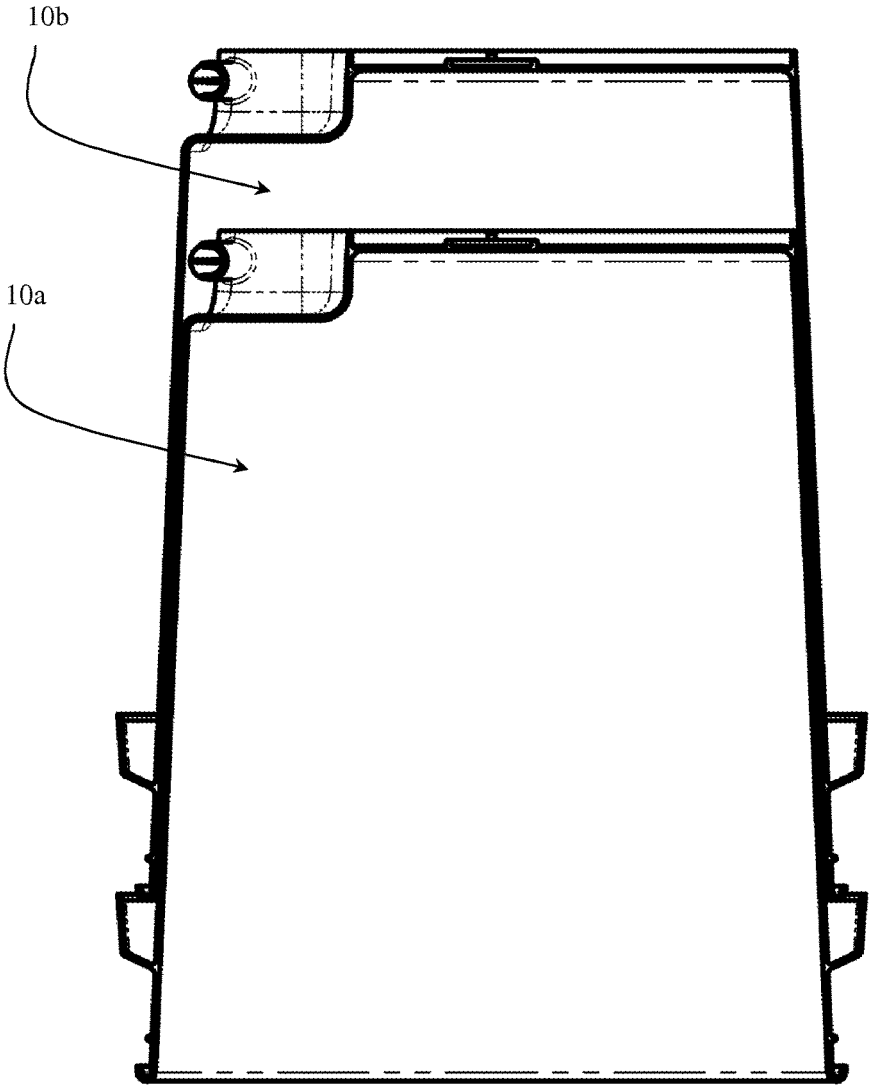
FIG. 7 is a sectional view of two inventive containers in a stacked position.

Lift handle 60, as shown in FIGS. 5-6, disposed within recess 60, includes laterally-opening generally U-shaped handle body 150 and extends across lift handle recess 50 (see FIG. 4). Longitudinal support 170 extends the length of handle body 150 and generally divides the interior of the U-shaped cavity defined thereby equally. Additional strength is added to handle body 150 by virtue of a plurality of spaced-apart vertical ribs 160. To improve manufacturing costs, the thickness of vertical ribs 160 and longitudinal support 170 are substantially equal to the other components of container 10, including handle body 150 and side wall 30. The component parts of handle 60 do not differ in thickness from that of side wall 30 (or each other) by more than 25%. In a preferred embodiment, the component parts of handle 60 do not differ in thickness from that of side wall 30 (or each other) by more than 15%.

Figure 8A:
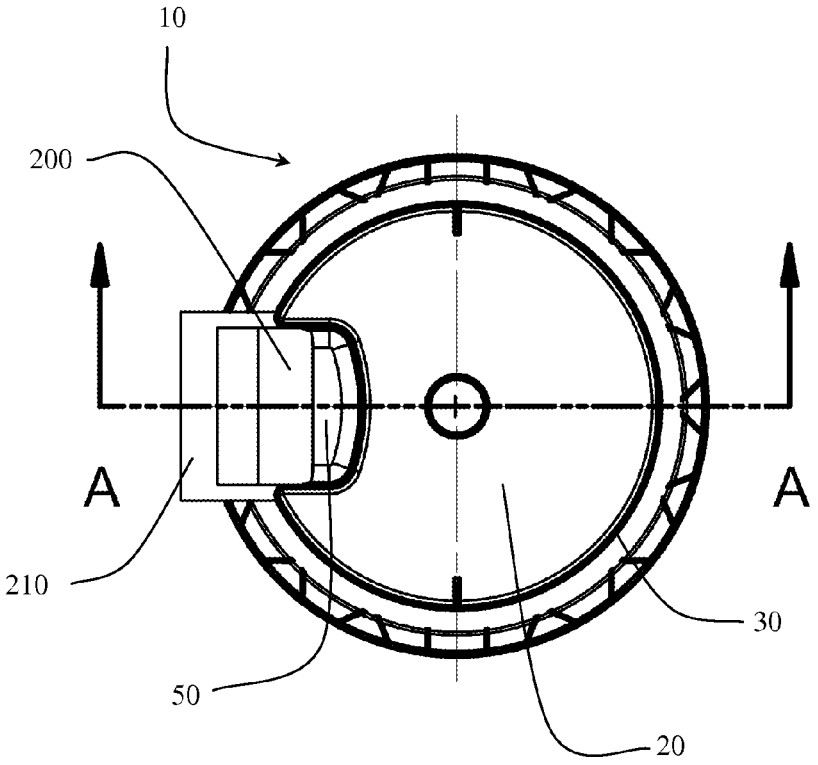
FIG. 8A is a bottom view of the inventive container with the lifter and slide (used in the molding process) in the "home" position.
Figure 8B:
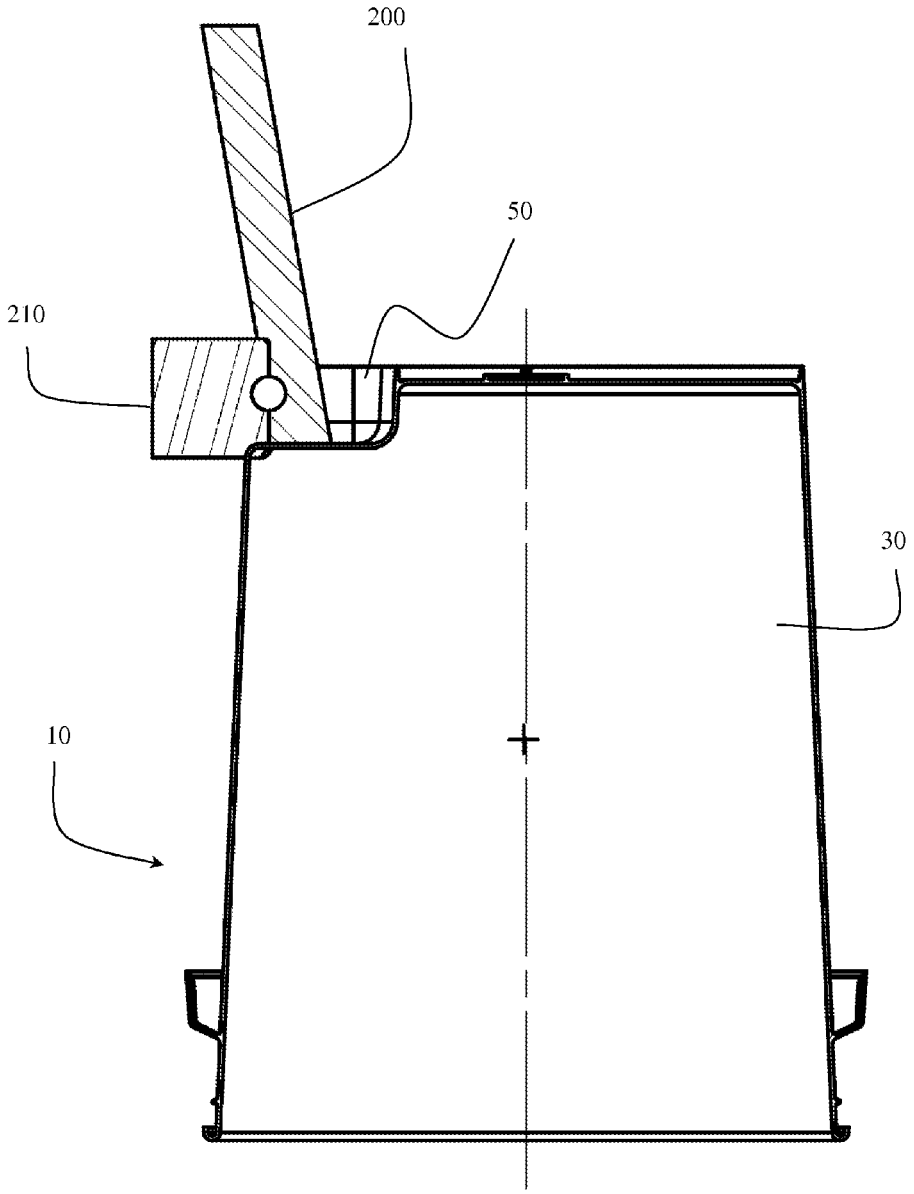
FIG. 8B is a sectional view (cut along section A-A of FIG. 8A) of the inventive container with the lifter and slide (used in the molding process) in the "home" position.
Figure 9A:
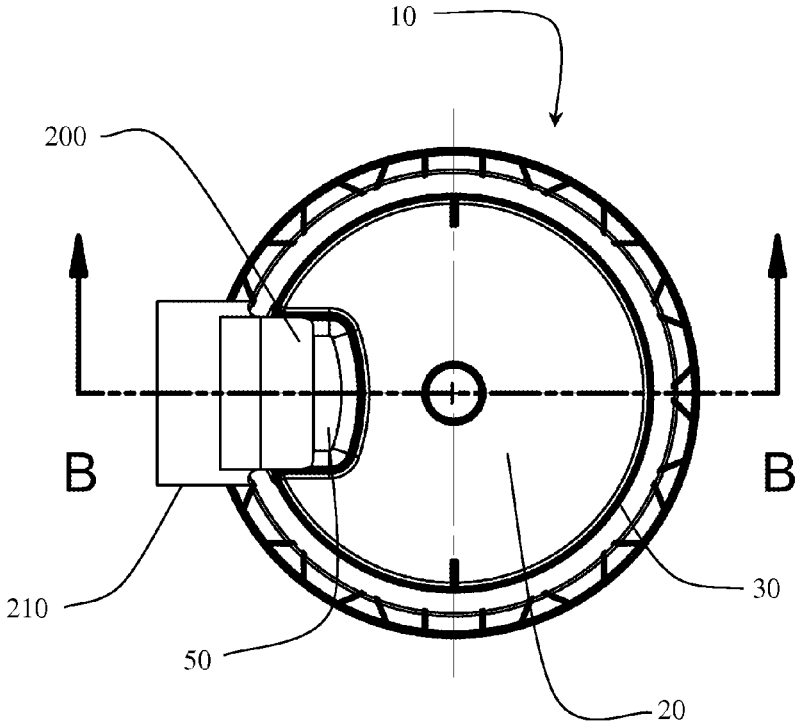
FIG. 9A is a bottom view of the inventive container with the lifter and slide (used in the molding process) in the "retracted" position.
Figure 9B:
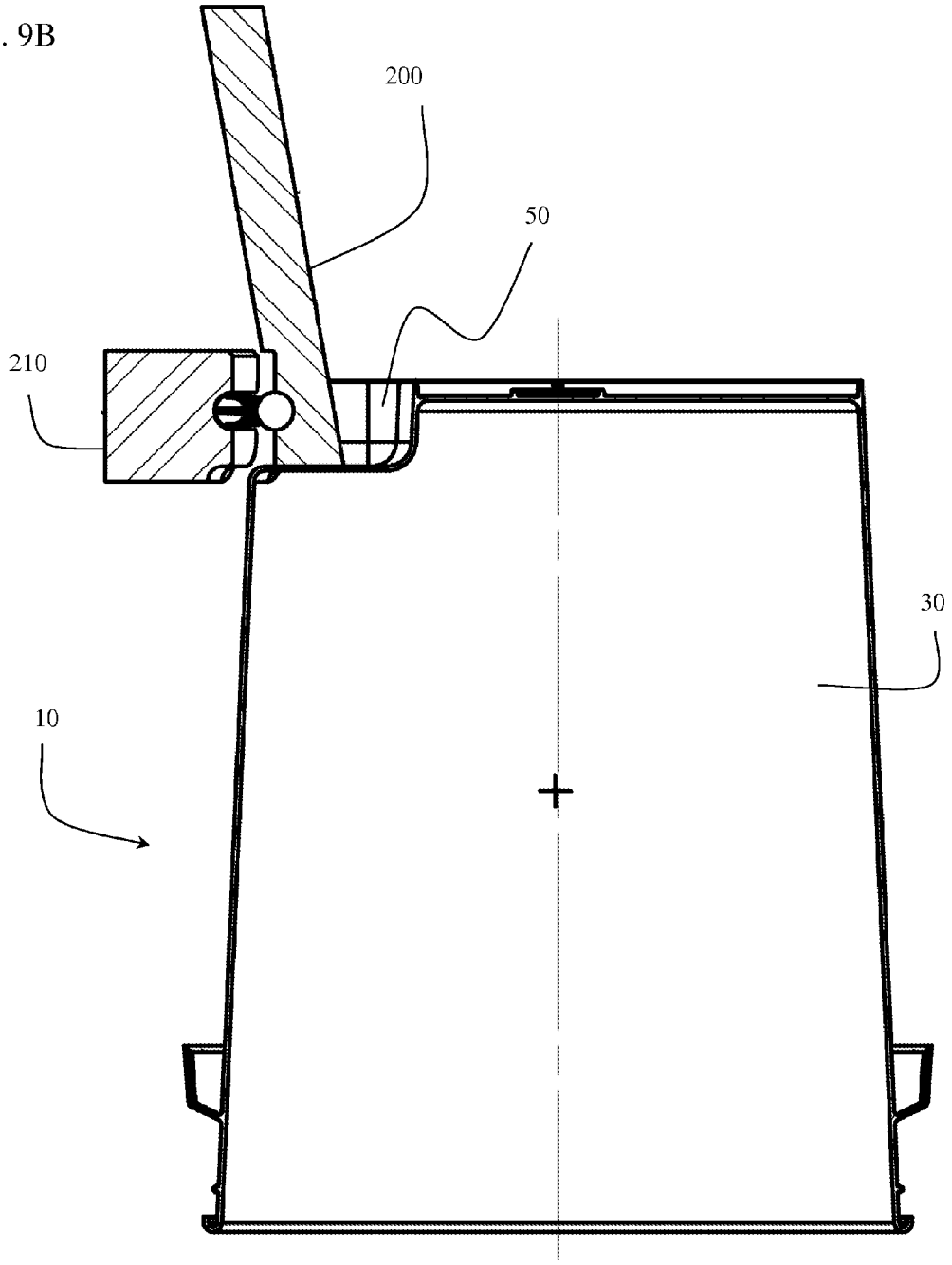
FIG. 9B is a sectional view (cut along section B-B of FIG. 9A) of the inventive container with the lifter and slide (used in the molding process) in the "retracted" position.

Fabrication of the uni-body injection molded container is illustrated in FIGS. 8A through 9B wherein molded container 10 is shown (Section A-A, FIG. 8A) with lifter 200 and slide 210 in the home position. During fabrication, the mold is closed with lifter 200 and slide 210 in the "home" position (FIGS. 8A/8B). Plastic is then injected in to the mold and allowed to cure. Next, slide 210 is withdrawn into the "retracted" position followed by withdrawal of slider 200 (see FIGS. 9A/9B). Lifter 200 and slide 210 can be withdrawn by any means known in the art. For example, floater 200 and/or slide 210 can be manipulated by mechanical cams (e.g. hydraulic) driven off a floating plate or direct acuation via a hydraulic cylinder.

As discussed, some advantages of the inventive container include improvements to the manufacture of a container having an integrally formed lower handle. To facilitate these improvements, component thickness is controlled to cut down on material used (cost) as well as curing time. For example, an exemplary container according to a preferred embodiment of the invention is a five-gallon bucket that has a side wall (30) thickness of about 40 mil to about 90 mil. In such an embodiment, the thickness of handle body (150) is substantially equal to the side wall (30) thickness and does not deviate by more than 25% but is ideally within 15% of the side wall (30) thickness. Similarly, the vertical and longitudinal supports (160, 170 respectively) are also within similar variances. Therefore, in a preferred embodiment wherein the side wall (30) had a thickness of about 70 mil, the thickness of the handle body (150) would be between about 52 mil and 88 mil or 59 mil and 81 mil.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense. Any materials, which may be cited above, are fully incorporated herein by reference.

It is also to be understood that the following claims are intended to cover all of the generic and specific features of the invention herein described, and all statements of the scope of the invention which, as a matter of language, might be said to fall therebetween. Relative terminology, such as "substantially" or "about," describe the specified materials, steps, parameters or ranges as well as those that do not materially affect the basic and novel characteristics of the claimed inventions as whole (as would be appreciated by one of ordinary skill in the art).

What is claimed is:

1. An integrally formed, injection-molded plastic container, comprising:

a. a container body having a base and a substantially circumferential container sidewall extending upwardly from the base, an upper end of the sidewall forming an open top for the container;

b. a recess formed in the substantially circumferential container sidewall adjacent the base; and c. a lower handle, located within the recess;

d. the lower handle being a plastic bail integrally molded with the container body;

e. wherein said base is of a lesser dimension than said open top and the substantially circumferential container side wall is tapered such that a first container body can be nested within an interior of a second container body; and f. wherein the recess comprises an upper wall extending inwardly from the container side wall, first and second opposing recess side walls extending inwardly from the container side and depending from the upper wall, and a terminal wall depending from the upper wall opposite the substantially circumferential container sidewall, and connecting the first and second opposing recess side walls, wherein the terminal wall is connected to the base along a lower end of said terminal wall, wherein said lower handle extends only from said first recess sidewall to said second recess sidewall; and g. wherein said lower handle comprises a body that is substantially U-shaped in cross section, said U-shaped cross section having an opening that is oriented away from said terminal wall; and wherein said lower handle comprises a plurality of spaced-apart vertical support structures disposed within the U-shaped body;

h. wherein all features of the container are formed by injection molding.

2. The container of claim 1, where the lower handle further comprises a longitudinal support member extending across the length of the handle within the U-shaped body.

3. The container of claim 1 wherein the U-shaped body has substantially the same thickness as the substantially circumferential container sidewall.

4. The container of claim 3 wherein the thickness of the U-shaped body is within about 25 percent of the thickness of the substantially circumferential container sidewall.

5. The container of claim 3 wherein the thickness of the U-shaped body is within about 15 percent of the thickness of the substantially circumferential container sidewall.

6. The container of claim 1, wherein said lower handle is contained completely within the recess and does not extend beyond the substantially circumferential container sidewall.

7. An integrally formed, injection-molded plastic container, comprising:

a. a container body having a base and a substantially circumferential container sidewall extending upwardly from the base, an upper end of the sidewall forming an open top for the container, the sidewall having a thickness of about 40 mil to about 90 mil;

b. a recess formed in the substantially circumferential container sidewall adjacent the base;

c. a lower handle, located within the recess and displaced inwardly of the substantially circumferential container sidewall, the lower handle being a plastic bail integrally molded with the container body; and d. the lower handle further comprising a body that is substantially U-shaped in cross section, a plurality of spaced-apart vertical support structures disposed within the U-shaped body, and a longitudinal support disposed within and extending along the length of the U-shaped body;

e. wherein the recess comprises an upper wall extending inwardly from the substantially circumferential container sidewall, first and second opposing recess side walls extending inwardly from the container side and depending from the upper wall, and a terminal wall depending from the upper wall opposite the substantially circumferential container sidewall, and connecting the first and second opposing recess side walls, wherein the terminal wall is connected to the base along a lower end of said terminal wall, wherein said lower handle extends only from said first recess sidewall to said second recess sidewall; and f. wherein said U-shaped cross section comprises an opening that is oriented away from said terminal wall; and g. wherein the thickness of U-shaped body wall is between about 55 mil and 70 mil; and h. wherein said base is of a lesser dimension than said open top and the substantially circumferential container side wall is tapered such that a first container body can be nested within an interior of a second container body; and i. wherein all features of the container are formed by injection molding.

8. The container of claim 7, wherein the respective ends of the lower handle are integrally molded with the opposing side walls.

9. The container of claim 7, wherein the U-shaped body has substantially the same thickness as the substantially circumferential container sidewall.

10. The container of claim 7 wherein the thickness of the U-shaped body is within about 25 percent of the thickness of the substantially circumferential container sidewall.

11. The container of claim 7 wherein the thickness of the U-shaped body is within about 15 percent of the thickness of the substantially circumferential container sidewall.

* * * * *